United States Patent [19]

Inokuti et al.

[11] Patent Number: 4,576,658

[45] Date of Patent: Mar. 18, 1986

[54] METHOD FOR MANUFACTURING GRAIN-ORIENTED SILICON STEEL SHEET

[76] Inventors: Yukio Inokuti, 664-25, Hagidai-cho, Chiba, Japan, 260; Yasuhiro Kobayashi, 1876, Tantakabayashi, Higashi-Nada-ku, Kobe-shi, Japan, 658; Yo Ito, 500-1, Kawata-cho, Chiba, Japan, 280

[21] Appl. No.: 677,675

[22] Filed: Nov. 30, 1984

[30] Foreign Application Priority Data

Dec. 2, 1983 [JP] Japan ..... 58-228174

[51] Int. Cl.[3] ..... H01F 1/04

[52] U.S. Cl. ..... 148/111; 148/113

[58] Field of Search ..... 148/110, 111, 112, 113

[56] References Cited

U.S. PATENT DOCUMENTS 3,823,042 7/1984 Bolling et al. ..... 148/112
4,268,326 5/1981 Iwayama et al. ..... 148/113
4,280,856 7/1981 Inokuti et al. ..... 148/111

FOREIGN PATENT DOCUMENTS 2114949 11/1971 Fed. Rep. of Germany ..... 148/113

*Primary Examiner*—John P. Sheehan
*Attorney, Agent, or Firm*—Wenderoth, Lind & Ponack

[57] ABSTRACT

A method for obtaining grain-oriented silicon steel sheet with a very high magnetic flux density and a very low core loss by setting specific conditions for the decarburization and primary recrystallization annealing step within the series of steps performed for the manufacture of the grain-oriented silicon steel sheet. This method consists of setting the rate of temperature rise in the decarburization and primary recrystallization annealing step at no less than 10° C./sec, dividing the decarburization and primary recrystallization annealing step into a first half and a second half, and restricting the temperature, time, and ratio $P_{H2O}/P_{H2}$ of the partial pressure of $H_2O$ to the partial pressure of $H_2$ of the atmosphere for each of these two halves within certain predefined ranges.

2 Claims, 2 Drawing Figures

METHOD FOR MANUFACTURING GRAIN-ORIENTED SILICON STEEL SHEET

BACKGROUND OF THE INVENTION

The present invention relates to a process for manufacturing grain-oriented silicon steel sheet having a high magnetic flux density, low core loss, and excellent magnetic properties. More specifically, it relates to the step therein of decarburization and primary recrystallization annealing prior to the secondary recrystallization annealing.

As is commonly known, grain-oriented silicon steel sheet is used primarily as the iron core in transformers and other electrical devices. This grain-oriented silicon steel sheet must have outstanding magnetic properties. This means that it must have a high magnetic flux density $B_{10}$ value (magnetic flux density at a magnetizing force of 1000 A/m) and a core loss $W_{17/50}$ value (core loss at a frequency of 50 Hz and a maximum flux density of 1.7 T).

The magnetic properties of such grain-oriented silicon steel sheet may be raised by achieving a high level of orientation in the secondary recrystallization <001> axis of the steel sheet or by restricting the amount of impurities and precipitates in the final product to an absolute minimum. A basic manufacturing process that achieves this by means of the two-stage cold rolling of grain-oriented silicon steel sheet was proposed by N. P. Goss, and has been upgraded by numerous modifications, which have produced constant improvements in magnetic flux density and core loss. Typical of these improvements are Japanese Patent Publication (Kokoku) No. 15644/1965, which proposes the utilization of an AlN precipitation phase, and Kokoku No. 14737/1982, which proposes the use of small amounts of molybdenum and antimony, and trace quantities of selenium or sulfur as inhibitors. In addition, other processes that represent refinements of these methods have also been proposed. One example is the process described in Kokoku No. 13846/1979 for warm rolling steps interspersed between a high-reduction cold rolling process, which is a refinement of the above-described process utilizing an AlN precipitate phase. Another example is the process described in Japanese Laid-open Patent Publication (Kokai) No. 93823/1981, which calls for quenching following intermediate annealing during the final cold rolling step; this is a refinement of the above process in Kokoku No. 14737/1982. The improvements achieved by these methods have allowed magnetic flux density $B_{10}$ values of above 1.89 T, and core loss $W_{17/50}$ values of below 1.05 W/kg to be achieved, making it possible to obtain high flux density, low core loss product.

The energy crisis several years ago precipitated strong demands for sharp reductions in electrical power loss in transformers and other electrical equipment, and at the same time raised hopes for greater reductions in core loss by iron core materials. One process for manufacturing grain-oriented silicon steel sheet of extremely low core loss that was recently disclosed in Kokoku No. 2252/1982 involves the reduction of core loss by laser irradiation of the surface of a finished sheet utilizing an AlN precipitate phase at intervals of several millimeters and perpendicular to the rolling direction so as to introduce artificial grain boundaries. However, methods introducing such artificial grain boundaries form local areas of high dislocation density. The resulting product remains stable during use only at low temperatures below 350° C., which is a decided disadvantage.

The inventors have conducted research on the mechanisms for the formation and growth of secondary recrystallization grains in the "Goss" orientation of grain-oriented silicon steel sheet, but on the basis of just x-ray diffraction studies have been unable to make any significant progress towards achieving grain-oriented silicon steel sheet with a higher magnetic flux density. As x-ray diffraction was far too inadequate for meaningful studies, they developed a new transmission Kossel apparatus that employs scanning electron images; this was disclosed in Kokai No. 33660/1980 and Japanese Laid-open Utility Model Publication No. 383349/1980. Using this apparatus, we closely studied samples of hot-rolled sheet, intermediate annealed sheet, decarburization and primary recrystallization sheet, initial secondary recrystallization sheet, and other sheet collected during the manufacture of grain-oriented silicon steel sheet. As a result of these studies, they made the following new discoveries (Y. Inokuti, et al., Trans. ISIJ, 23, p. 440, 1983):

(1) Nucleus formation of secondary recrystallization grains with an orientation of {110}<001> arises from strain-free regions of unrecrystallized grains having a {110}<001> orientation near the surface of the heat-rolled sheet and is inherited by means of structure memory.

(2) The secondary recrystallization nuclei having a {110}<001> orientation preferentially formed near the surface of the steel sheet following the decarburization/primary recrystallization annealing step that precedes secondary recrystallization annealing are large nuclei arising from the coalescence of several primary recrystallization nuclei of {110}<001> orientation.

(3) If a small amount of molybdenum is added, this inhibits recrystallization in the vicinity of the hot-rolled sheet surface, resulting in the preferential formation of unrecrystallized grains with a {110}<001> orientation. Moreover, unrecrystallized grains with a {110}<001> orientation that become secondary recrystallization nuclei are preferentially formed. The present occupancy by strain-free regions of unrecrystallization nuclei with a {110}<001> orientation that become secondary recrystallization nuclei is about three times as large as when molybdenum is not added, and the frequency of {110}<001> secondary recrystallization nuclei formation is also about three times as great (Y. Inokuti et al., Tetsu-to-Hagane 69, p. 1284, 1983).

On the basis of these new findings, the inventors also conducted studies on the optimal decarburization and primary recrystallization annealing conditions for grain-oriented silicon steel sheet. In particular, they conducted a series of experiments on the high-grade grain-oriented silicon steel sheet with improved surface properties resulting from the addition of a trace quantity of molybdenum which they proposed in Japanese Patent Application No. 90040/1983 to determine the optimal decarburization and primary recrystallization annealing conditions. When a small amount of molybdenum is added, this has a number of effects: (1) it delays recrystallization, increasing the frequency of secondary recrystallization nuclei formation; and (2) the forsterite following secondary recrystallization annealing forms a uniform thin coating. They conducted a careful study to determine the annealing conditions that maximize the effects of the presence of a small amount of molybdenum, and discovered from this that outstanding grain-oriented silicon steel sheet with a high magnetic flux density and a low core loss can be obtained through decarburization primary recrystallization annealing by rapid heating at an average rate of temperature increase of over 10° C. per second from 400° to 750° C., annealing at 780° to 820° C. for 50 seconds to 10 minutes in an oxidizing atmosphere with a $P_{H2O}/P_{H2}$ of 0.4 to 0.7, and annealing at 830° to 870° C. for 10 seconds to 5 minutes in an oxidizing atmosphere with a $P_{H2O}/P_{H2}$ of from 0.008 to 0.4. This led ultimately to the present invention.

The object of the present invention is to provide a process for manufacturing grain-oriented silicon steel sheet with an increased magnetic flux density and very low core loss.

SUMMARY OF THE INVENTION

The method of the present invention is a process for manufacturing grain-oriented silicon steel sheet comprising the successive steps of hot-rolling silicon steel material containing 0.01 to 0.06 wt % carbon, 2.0 to 4.0 wt % silicon, 0.01 to 0.2 wt % manganese, and a total of 0.005 to 0.1 wt % of sulfur and/or selenium; setting the final sheet thickness by cold rolling once, or cold rolling two or more times, while interspersing an intermediate annealing step between each cold rolling step; decarburization and primary recrystallization annealing; and final finish annealing to induce the growth of secondary recrystallization grains with a {110}<001> orientation, wherein the decarburization and primary recrystallization annealing process comprises the steps of rapid-heating in the temperature range of 400° C. to 750° C. at an average rate of temperature rise of at least 10° C./sec, annealing for 50 seconds to 10 minutes within a temperature range of 780° to 820° C. in an oxidizing atmosphere having a ratio $P_{H2O}/P_{H2}$ in the partial pressure of $H_2O$ to the partial pressure of $H_2$ of from 0.4 to 0.7, then annealing for 10 seconds to 5 minutes within a temperature range of 830° to 870° C. in an oxidizing atmosphere for which the ratio in partial pressures $P_{H2O}/P_{H2}$ ranges from 0.08 to 0.4. Moreover, the method of this invention also performs the above processes using silicon steel containing 0.005 to 0.1 wt % of molybdenum and 0.005 to 0.2 wt % of antimony, in addition to the above-mentioned silicon steel components.

BRIEF DESCRIPTION OF THE DRAWINGS

FIG. 1 plots the relationship of temperature, holding time, and $P_{H2O}/P_{H2}$ value versus the magnetic properties of the product during the first half of the decarburization and primary recrystallization annealing step; and FIG. 2 plots the relationship of temperature, holding time, and $P_{H2O}/P_{H2}$ value versus the magnetic properties of the product.

DETAILED DESCRIPTION OF THE INVENTION

Figure 1:
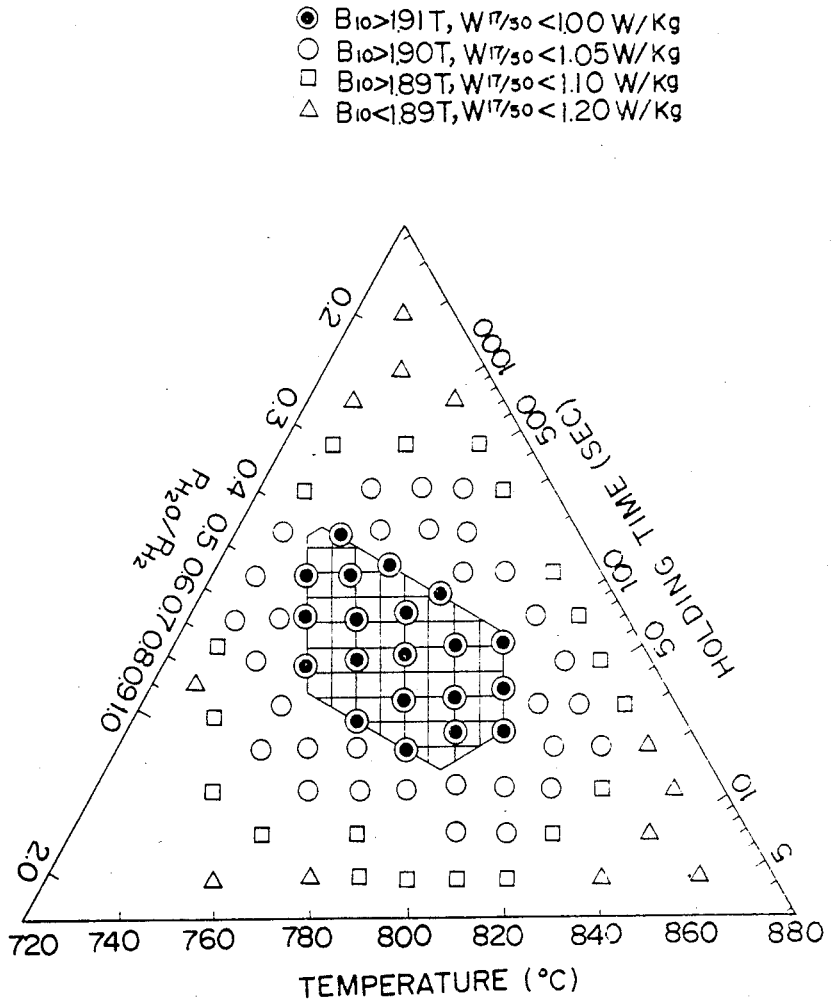
FIGS. 1 and 2 show the relationship between the annealing conditions and the magnetic properties of the product during the decarburization and primary recrystallization annealing step.

We shall begin by describing the experiments that formed the basis for this invention.

Silicon steel material containing 0.0045 wt % carbon, 3.35 wt % silicon, 0.013 wt % molybdenum, 0.018 wt % selenium, 0.025 wt % antimony, and 0.065 wt % manganese was hot-rolled to a thickness of 2.7 mm, homogenization annealed for 3 minutes at 900° C., cold rolled at a reduction ratio of 75%, intermediate annealed for 3 minutes at 950° C., then cold rolled again at a reduction ratio of 63% to a final sheet thickness of 0.3 mm. Following this, decarburization and primary recrystallization annealing were performed, and annealing then carried out by either process A or B.

Process A: The sheet was rapid-heated from 400° to 750° C. at an average rate in temperature increase of 15° C./sec, annealed at various temperatures from 760° to 860° C. for various holding times ranging from 6 to 1300 seconds in various oxidizing atmospheres with $P_{H2O}/P_{H2}$ values ranging from 0.18 to 1.6, then annealed again for 60 seconds at 835° C. in an oxidizing atmosphere with a $P_{H2O}/P_{H2}$ value of 0.35.

Process B: The sheet was rapid-heated from 400° to 750° C. at an average rate of temperature increase of 15° C./sec, annealed at a temperature of 820° C. for 150 seconds in an oxidizing atmosphere with a $P_{H2O}/P_{H2}$ of 0.50, then annealed at one of several temperatures between 790° and 910° C., for various periods of time ranging from 2.5 to 900 seconds in an oxidizing atmosphere having a $P_{H2O}/P_{H2}$ value ranging from 0.016 to 1.8.

The steel sheet surfaces of the specimens treated by process A or process B were coated with an annealing separator of which the primary component was MgO, then secondary recrystallization annealing carried out by placing these in a 850° C. argon gas atmosphere for 50 hours. Following this, purification annealing was performed for 5 hours at 1180° C. in hydrogen gas. The magnetic properties of each of the products obtained versus the temperature, time, and $P_{H2O}/P_{H2}$ conditions of the decarburization and primary recrystallization annealing step are shown as triangular plots in FIGS. 1 and 2.

Figure 2:
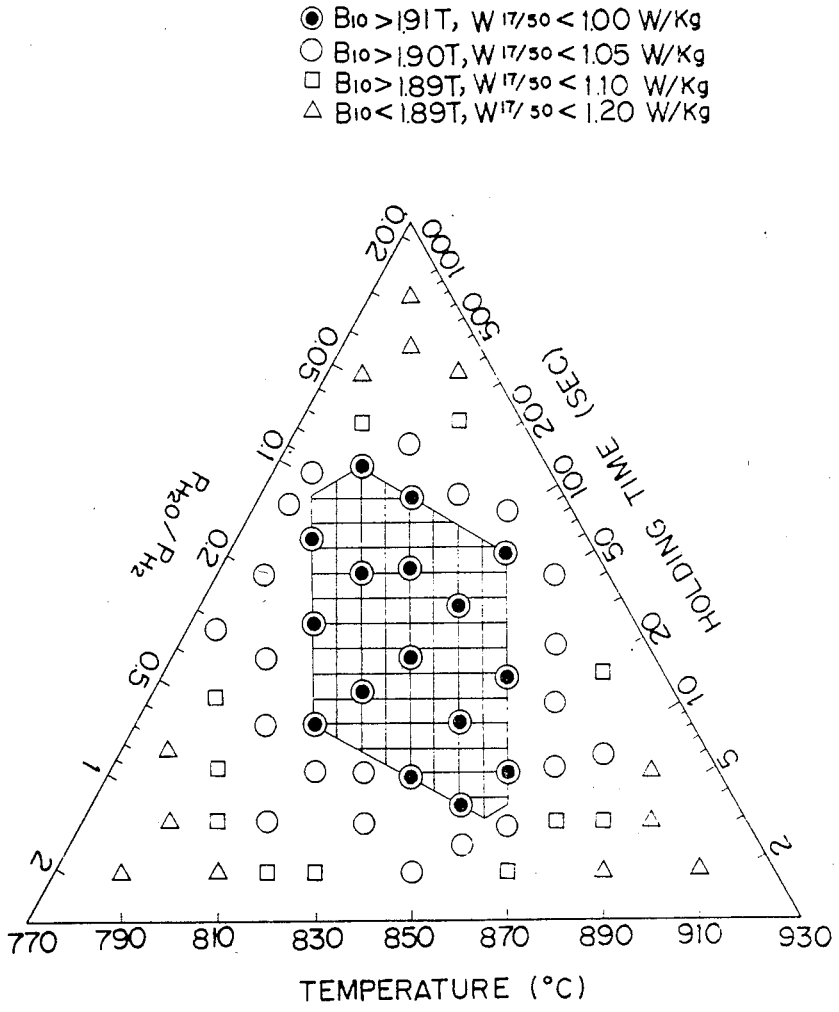

FIG. 1 shows the conditions of process A; i.e., the annealing conditions in the first half of the decarburization and primary recrystallization annealing process. This figure indicates that excellent magnetic properties were obtained at a temperature of 780° to 820° C., a holding time ranging from 50 to 600 seconds, and a $P_{H2O}/P_{H2}$ ranging from 0.4 to 0.7 in the first half of this step: the magnetic flux density $B_{10}$ value was over 1.91 T, and the core loss $W_{17/50}$ value was below 1.00 W/kg. FIG. 2 shows the magnetic properties obtained under the conditions of process B; that is, under a variety of annealing conditions in the second half of the decarburization and primary recrystallization annealing step. This figure indicates that excellent magnetic properties were obtained at a temperature of 830° to 870° C., a holding time ranging from 10 to 300 seconds, and a $P_{H2O}/P_{H2}$ ranging from 0.08 to 0.4 in the second half of the step: the magnetic flux density $B_{10}$ value was over 1.91 T, and the core loss $W_{17/50}$ value was below 1.00 W/kg. In the experiment conducted using process A, the annealing conditions in the second half of the step fell within the range of conditions for which excellent magnetic properties were obtained in the experiment using process B. Similarly, in the experiment conducted using process B, the annealing conditions in the first half of the step fell within the range of conditions for which excellent magnetic properties were obtained in the experiment using process A. The above outstanding magnetic properties can be obtained by combining both sets of conditions and annealing first at a temperature ranging from 780° to 820° C. for 50 to 600 seconds in an oxidizing atmosphere having a $P_{H2O}/P_{H2}$ of 0.4 to 0.7, then annealing at a temperature of 830° to 870° C. for 10 to 300 seconds in an oxidizing atmosphere having a $P_{H2O}/P_{H2}$ of 0.08 to 0.4.

Apparently, the above outstanding magnetic properties can be obtained because the rapid heating process during the temperature rise stage of the decarburization and primary crystallization annealing step promotes the preferential nucleus formation of secondary grains with an orientation of {110}<001>. In addition, it was possible to produce a primary recrystallization aggregate structure in which full use was made of the effects of the presence of a small amount of molybdenum by dividing the decarburization and primary recrystallization annealing step into a first half and a second half, and applying suitable conditions to each half.

We also performed the following experiment. Silicon steel (I) containing 0.040 wt % carbon, 3.16 wt % silicon, 0.018 wt % selenium, 0.025 wt % antimony, and 0.072 wt % manganese, and silicon steel (II) containing 0.039 wt % carbon, 3.36 wt % silicon, 0.018 wt % sulfur, and 0.068 wt % manganese were each hot-rolled by a standard process. The hot-rolled sheets thus obtained were cold-rolled twice, once before and once after an intermediate annealing step carried out at 950° C. for 3 minutes, giving final cold-rolled sheets with a thickness of 0.3 mm. Following this, the sheets were subjected to decarburization and primary recrystallization annealing under conditions (a)–(d) below.

(a) The sheet was rapid-heated at a rate of 15° C./sec from 400° to 750° C., annealed for 2 minutes at 820° C. in an oxidizing atmosphere with a $P_{H2O}/P_{H2}$ of 0.50, then annealed again for one minute at 835° C. in an oxidizing atmosphere at a $P_{H2O}/P_{H2}$ of 0.35.

(b) The sheet was heated at a rate of 7° C./sec from 400° to 750° C., annealed for 2 minutes at 820° C. in an oxidizing atmosphere with a $P_{H2O}/P_{H2}$ of 0.50, then annealed again for one minute at 835° C. in an oxidizing atmosphere at a $P_{H2O}/P_{H2}$ of 0.35.

(c) The sheet was rapid-heated at a rate of 15° C./sec from 400° to 750° C., then annealed for 3 minutes at 820° C. in an oxidizing atmosphere with a $P_{H2O}P_{H2}$ of 0.50.

(d) The sheet was heated at a rate of 7° C./sec from 400° to 750° C., then annealed for 3 minutes at 820° C. in an oxidizing atmosphere with a $P_{H2O}/P_{H2}$ of 0.50.

After carrying out decarburization and primary recrystallization annealing under these conditions, annealing separator consisting primarily of MgO was applied to the surface of the steel sheet, following which the sheet was subjected to secondary recrystallization annealing for 50 hours at 850° C., followed by purification annealing in hydrogen gas at 1180° C. for 5 hours. The magnetic properties of each of the products thus obtained are shown in Table 1 for the respective decarburization and primary recrystallization conditions and the two different steel compositions.

TABLE 1

| Decarburization/ primary recrystallization annealing conditions | Magnetic properties of product from steel (I) | | Magnetic properties of product from steel (II) | |
|---|---|---|---|---|
| | $B_{10}$ (T) | $W_{17/50}$ (w/kg) | $B_{10}$ (T) | $W_{17/50}$ (w/kg) |
| (a) | 1.92 | 1.06 | 1.88 | 1.14 |
| (b) | 1.90 | 1.11 | 1.87 | 1.20 |
| (c) | 1.90 | 1.09 | 1.87 | 1.17 |
| (d) | 1.89 | 1.13 | 1.86 | 1.23 |

It is clear from Table 1 that product obtained by performing decarburization and primary recrystallization annealing under the conditions in (a), i.e., the conditions within the scope defined for this invention, have magnetic properties superior to product obtained by applying decarburization and primary recrystallization annealing under the conditions in (b)–(d). The conditions in (b) are identical to those in (a), except that the rate of temperature increase from 400° to 750° C. during decarburization and primary recrystallization annealing is slower. Yet, the magnetic properties of the resulting product are poorer than those of the product obtained under the conditions in (a), the core loss in particular being large. From this we learned that the rate of temperature rise during decarburization and primary recrystallization annealing is a factor that significantly affects the magnetic properties.

The silicon steel used in the experiments in Table 1 do not contain molybdenum, which is why the magnetic properties obtained are not as good as those in high-grade grain-oriented silicon steel sheet containing a small amount of molybdenum. Nevertheless, applying conditions (a) results in better magnetic properties than the use of conditions (b)–(d). As a result, an appropriate primary recrystallization texture can be formed, just as when a small amount of molybdenum is added.

The separation of the decarburization and primary recrystallization annealing cycle in grain-oriented silicon steel sheet fabrication into an initial low-temperature recrystallization annealing step and a subsequent high-temperature recrystallization annealing step has already been disclosed in Kokoku Nos. 38652/1981 and 16769/1965. In addition, Kokoku No. 160514/1979 discloses a process in which the oxidizing degree of the atmosphere is changed from the first to the second half of the decarburization annealing process. Kokoku No. 24686/1979 discloses a process in which decarburization annealing is performed at a temperature of 750° to 870° C., following which annealing is performed in a non-oxidizing atmosphere at a temperature of 890° to 1050° C. prior to final annealing. However, none of these methods clearly specifies the rate of temperature rise during decarburization annealing, nor are the conditions of decarburization annealing clearly delineated as in the process according to the present invention. Thus, the present invention was conceived on a basis entirely different from that of earlier methods. Moreover, the magnetic properties of the product are clearly superior to those of product obtained by the other methods.

We shall now explain the reasons for placing limits on the contents of components in the silicon steels used in the method of the present invention.

When less than 2.0 wt % of silicon is used, the electrical resistance is low, and core loss based on eddy current loss becomes large. At the same time, the use of more than 4.0 wt % tends to result in brittle cracking during cold rolling. Hence the requirement for 2.0–4.0 wt % of silicon.

At less than 0.1 wt % of carbon, control of the hot-rolled texture becomes difficult. As a result, elongated grains form, resulting in deterioration of the magnetic properties. A carbon content of more than 0.06 wt % lengthens the time required for decarburization in the decarburization annealing process, which is uneconomical. Thus, the carbon content should fall within a range of 0.01 to 0.06 wt %.

Manganese is an important component that determines the MnS or MsSe content in the dispersed precipitate phase (inhibitor) which controls the secondary recrystallization of grain-oriented silicon steel sheet. When the manganese content is less than 0.01 wt %, there is insufficient MnS or MsSe to induce secondary recrystallization; the result is incomplete secondary recrystallization and an increase in the size of the surface defects known as "blisters". However, if the manganese content exceeds 0.2 wt %, then dissociative dissolution of the MnS or MnSe during slab heating becomes difficult. Even if dissociative dissolution is achieved, the dispersed precipitate phase precipitated within the hot-rolled sheet tends to become coarse-grained, resulting in the loss of the optimal size distribution for an inhibitor and a deterioration in magnetic properties. Accordingly, the manganese content should lie within the range of 0.01–0.2 wt %.

One or both of the components sulfur and selenium may be added to form the MnS and/or MnSe in the dispersed precipitation phase (inhibitor) described above. The total content of these two components should be no more than 0.1 wt %, of which the selenium content should range from 0.008 to 0.1 wt %, and the selenium content from 0.003 to 0.1 wt %. If the total sulfur and selenium content or the contents of either of these components exceeds 0.1 wt %, this has adverse effects on the hot and cold workability. However, when the sulfur content is less than 0.008 wt % or the selenium content is less than 0.003 wt %, the primary growth inhibiting action of MnS and MnSe on primary recrystallized grains hardly takes effect. In the method of the present invention, existing grain growth inhibitors such as molybdenum and antimony may be effectively used together with the above inhibitors, making it possible to set the lower limit in the total sulfur and selenium content at 0.005 wt %.

The use of antimony in combination with MnS and MnSe has the function of reinforcing the effect of inhibiting grain growth on primary recrystallized grains. However, at a content of less than 0.005 wt %, this effect is small, while a content in excess of 0.2 wt % reduces the magnetic flux density, weakening the magnetic properties. Hence, a range in antimony content of 0.005–0.2 wt % is required.

The addition of molybdenum also has the effect of inhibiting grain growth in primary recrystallized grains, but a content in excess of 0.1 wt % reduces hot and cold workabilities and increases core loss. At less than 0.003 wt %, however, the effect of inhibiting grain growth is small. Hence, the molybdenum content was set at 0.003–0.1 wt %.

Either of two silicon steels may be used in the method of the present invention: one containing 2.0–4.0% silicon, 0.01–0.06% carbon, 0.01–0.2% manganese, and a total of 0.005–0.1% of sulfur and/or selenium as the basic components, the remainder being iron and unavoidable impurities, or one containing 2.0–4.0% silicon, 0.01–0.06% carbon, 0.01–0.2% manganese, a total of 0.005–0.1% of sulfur and/or selenium, and 0.005–0.1 molybdenum and/or 0.05–0.2% antimony as the basic components, the remainder being iron and unavoidable impurities. However, the presence of trace amounts of other known elements commonly present in silicon steel, such as chromium, titanium, vanadium, zirconium, niobium, tantalum, cobalt, nickel, tin, phosphorus, and arsenic is also permissible.

The series of processes employed in the manufacturing method of the present invention shall now be described.

First, liquid steel containing the above components is prepared and cast as a slab. An LD converter, an electric furnace, an open-hearth furnace, or some other known steelmaking process may be used. These processes may also be used in combination with vacuum processing or vacuum refining. Any existing method familiar to the art may be used for the addition of the sulfur, selenium, antimony, and molybdenum to molten steel. For example, addition to molten steel in the LD converter, at the completion of RH degassing, or in the ingot casting stage is possible. In the case of slab fabrication, the use of continuous casting is preferable on account of such factors as the large reductions in cost resulting from improved yield and the elimination of processing steps, and the longitudinal uniformity of composition and quality in the slab. However, the use of other existing ingot casting and blooming methods is also acceptable.

Slabs obtained in the above manner are hot-rolled by a known process. Although the thickness of the hot-rolled slab is controlled in accordance with the subsequent cold-rolling process and the product thickness, this thickness is generally set at 1.6–3.5 mm. After being subjected, if necessary, to homogenization annealing, this hot-rolled sheet is supplied to the cold-rolling step.

Two or more cold-rolling steps are normally carried out, between each of which is interspersed an intermediate annealing step at a temperature ranging from 850° to 1050° C. The reduction rate in primary cold-rolling is normally set at about 50–80%, and the subsequent reduction rate at about 55–75%, while the final sheet thickness is normally set at about 0.23–0.35 mm.

Decarburization and primary recrystallization annealing is performed on steel sheet having this final thickness. The main purpose of this annealing process is both to convert the cold-rolled structure into a primary recrystallization structure and to remove carbon that induces harmful effects during the growth of secondary recrystallization grains having a {110}<001> orientation during final finish annealing; this is a process of critical importance to the present invention.

The present invention provides that, during temperature rise steps leading up to decarburization and primary recrystallization annealing, the rate of temperature rise, particularly in the temperature range from 400° to 750° C., be controlled to at least 10° C./sec in order to obtain product with a high magnetic flux density and an ultralow core loss. When the rate of temperature rise over this temperature range is less than 10° C./sec, product having the anticipated high magnetic flux density and ultralow core loss cannot be obtained even when the temperature, atmosphere, and period of annealing fall within the stipulated ranges for the present invention. Hence, any existing and widely known methods of rapid-heating may be used during decarburization and primary recrystallization annealing. For instance, when rapid-heating with a continuous furnace, improvements may be made in the heating performance of the heating zone (temperature-rise zone) of the continuous oven, or a heating zone may be additionally installed in an induction furnace and rapid-heating performed.

The decarburization and primary recrystallization annealing step following rapid heating has hitherto been performed at constant values in the oxidizing degree of the atmosphere and the temperature, within given respective ranges. In the method of the present invention, this step is divided into a first half and a second half, and the annealing process controlled such that annealing is first carried out in the first half for 30 seconds to 10 minutes at 780° to 820° C. in an oxidizing atmosphere with a $P_{H2O}/P_{H2}$ value of 0.4 to 0.7, then is carried out in the second half of the step for 10 seconds to 5 minutes at 830° to 870° C. in an oxidation atmosphere with a $P_{H2O}/P_{H2}$ of 0.08 to 0.4. By setting the annealing temperature in the first half of this process at a value lower than that in the second half, and making the oxidizing degree of the atmosphere in the first half of the process higher than that in the second half, a product having outstanding magnetic properties and an excellent coating can be obtained. If the annealing temperature and oxidizing degree of the atmosphere during the first half of the process and these same conditions in the second half of the process are within the above-specified ranges, there is no need for these to be fixed values, and they may be gradually changed within these ranges. Moreover, in the actual annealing operation, there is no need to clearly divide the first and second halves of the process, provided the conditions in the first half of the process and the conditions specified for the second half of the process are each satisfied in the proper order. This decarburization and primary recrystallization annealing process is normally carried out in a continuous furnace, in which case the aforementioned conditions may be easily attained by appropriate adjustment of the temperature conditions and atmosphere settings in the zone for the first half of the annealing process and the zone for the second half of the annealing process. Instead of a continuous furnace, two batch furnaces may be used, one of which is set at the first-half conditions and the other of which is set at the second-half conditions. In this case, the object of the present invention can be attained even if the steel sheet is first processed at the conditions in the first half of the annealing process, the temperature of the sheet reduced to room temperature or almost room temperature, and the sheet subsequently processed under the conditions of the second half of the annealing step.

An annealing separator the primary component of which is normally MgO is applied to the surface of the steel sheet following decarburization and primary recrystallization in order to prevent adhesion in colied sheet during final annealing, known here also as secondary crystallization and purification annealing, and to obtain a good, thin insulating coating.

The final annealing process carried out on the steel sheet following application of the annealing separator is performed to fully induce growth of secondary recrystallization grains with a {110}<001> orientation, and for the removal of impurities in the steel. Normally this process is performed by batch annealing whereby the steel sheet is raised immediately to at least 1000° C., and annealing carried out at this temperature. However, to induce the growth of a secondary recrystallization structure that is very highly oriented with the {110}<001> orientation, it is advantageous to anneal at a low temperature of about 820° to 900° C.; gradual-heat annealing may also be carried out at, for example, a rate of temperature rise of from 0.5° to 15° C.

The following examples provide a more concrete illustration of the objects and advantages of the present invention.

EXAMPLE 1

After hot-rolling a steel ingot containing 0.045% carbon, 3.33% silicon, 0.018% molybdenum, 0.025% antimony, and 0.018% selenium, with the remainder being iron and unavoidable impurities, by means of a standard process, the hot-rolled steel was homogenization annealed for 3 minutes at 900° C., then cold-rolled twice, in between which was carried out an intermediate annealing step for 3 minutes at 950° C., giving a final rolled sheet with a thickness of 0.3 mm. Following this, decarburization and primary recrystallization annealing was carried out under the following conditions. The sheet was rapid-heated at an average temperature rise rate of 12° C./sec in the temperature range of 400° to 750° C., annealed for 2 minutes at 820° C. in an oxidizing atmosphere with a $P_{H2O}/P_{H2}$ of 0.40, then annealed again for one minute at 835° in an oxidizing atmosphere at a $P_{H2O}/P_{H2}$ of 0.20. After decarburization and primary recrystallization annealing under these conditions, annealing separator containing MgO as the primary component was applied to the surface of the steel sheet, and a final annealing process carried out that consisted of secondary recrystallization annealing for 5 hours at 850° C., followed by purification annealing for 5 hours at 1180° C. This gave a grain-oriented silicon steel sheet product. The magnetic properties of this product were investigated and found to be excellent; the magnetic flux density $B_{10}$ value was 1.91 T, and the core loss $W_{17/50}$ value was 0.97 w/kg.

EXAMPLE 2

A 2.2 mm hot-rolled sheet was obtained by hot-rolling a steel ingot containing 0.041% carbon, 3.45% silicon, 0.019% molybdenum, 0.025% antimony, and 0.018% selenium, with the remainder being iron and unavoidable impurities, and quenching from 550° C. This hot-rolled sheet was cold rolled twice, in between which was carried out an intermediate annealing step for 3 minutes at 950° C., giving a final cold-rolled sheet with a thickness of 0.23 mm. This cold-rolled sheet was decarburization and primary recrystallization annealed under the following conditions. The sheet was rapid-heated at a temperature rise rate of 15° C./sec in the temperature range of 400° to 750° C., annealed for 2 minutes at 800° C. in an oxidizing atmosphere with a $P_{H2O}/P_{H2}$ of 0.38, then annealed again for one minute at 840° in an oxidizing atmosphere at a $P_{H2O}/P_{H2}$ of 0.18. Following this, annealing separator containing MgO as the primary component was applied to the surface of the steel sheet, and a final annealing process carried out that consisted of secondary recrystallization annealing for 50 hours at 850° C., followed by purification annealing for 5 hours at 1180° C. This gave a grain-oriented silicon steel sheet product. The magnetic properties of this product were investigated and found to be excellent; the magnetic flux density $B_{10}$ value was 1.91 T, and the core loss $W_{17/50}$ value was 0.78 w/kg.

EXAMPLE 3

A 2.4 mm hot-rolled sheet was obtained by hot-rolling a steel ingot containing 0.043% carbon, 3.15% silicon, 0.018% sulfur, and 0.072% manganese. This hot-rolled sheet was cold rolled twice, in between which was carried out an intermediate annealing step for 3 minutes at 900° C., giving a final cold-rolled sheet with a thickness of 0.27 mm. This cold-rolled sheet was decarburization and primary recrystallization annealed under the following conditions. The sheet was rapid-heated at an average temperature rise rate of 20° C./sec in the temperature range of 400° to 750° C., annealed for 2 minutes at 820° C. in an oxidizing atmosphere with a $P_{H2O}/P_{H2}$ of 0.5, then annealed again for 30 seconds at 840° in an oxidizing atmosphere at a $P_{H2O}/P_{H2}$ of 0.25. Following this, annealing separator containing MgO as the primary component was applied to the surface of the steel sheet, and a final annealing process carried out that consisted of secondary recrystallization annealing at a temperature rise rate of 5° C./hr from 820° C., followed by purification annealing for 5 hours at 1180° C. in hydrogen. This gave a grain-oriented silicon steel sheet product. The magnetic properties of this product were investigated and found to be excellent; the magnetic flux density $B_{10}$ value was 1.88 T, and the core loss $W_{17/50}$ value was 1.12 w/kg.

According to the method of the present invention, by appropriate selection of the conditions for decarburization and primary recrystallization annealing, grain-oriented silicon steel sheet having truly outstanding magnetic properties can be obtained in practice. These magnetic properties consist of a high magnetic flux density and a very low core loss.

We claim:

1. A method of manufacturing grain-oriented silicon steel sheet comprising the successive steps of:

hot-rolling silicon steel material containing 0.01 to 0.06 wt % carbon, 2.0 to 4.0 wt % silicon, 0.01 to 0.2 wt % manganese, and a total of 0.005 to 0.1 wt % of sulfur and/or selenium;

setting the final sheet thickness by cold rolling once, or cold rolling two or more times, while interspersing an intermediate annealing step between each cold rolling step;

decarburization and primary recrystallization annealing; and final finish annealing to induce the growth of secondary recrystallization grains having a {110}<001> orientation, wherein said decarburization and primary recrystallization annealing process comprises rapid-heating in the temperature range of 400° C. to 750° C. at an average temperature rise rate of at least 10° C./sec, annealing for 50 seconds to 10 minutes within a temperature range of 780° to 820° C. in an oxidizing atmosphere having a ratio of the partial pressure of $H_2O$ to the partial pressure of $H_2$, $P_{H2O}/P_{H2}$, of from 0.4 to 0.7, then annealing for 10 seconds to 5 minutes within a temperature range of 830° to 870° C. in an oxidizing atmosphere for which the ratio in partial pressures $P_{H2O}/P_{H2}$ ranges from 0.08 to 0.4.

2. A process for manufacturing grain-oriented silicon steel sheet comprising the successive steps of:

hot-rolling silicon steel containing 0.01 to 0.06 wt % carbon, 2.0 to 4.0 wt % silicon, 0.01 to 0.2 wt % manganese, a total of 0.005 to 0.1 wt % of sulfur and/or selenium, and also 0.005 to 0.1 wt % of molybdenum and/or 0.005 to 0.2 wt % of antimony;

setting the final sheet thickness by cold rolling once, or cold rolling two or more times, while interspersing an intermediate annealing step between each cold rolling step;

decarburization and primary recrystallization annealing; and final finish annealing to induce the growth of secondary recrystallization grains with a {110}<001> orientation, wherein said decarburization and primary recrystallization annealing process comprises rapid-heating in the temperature range of 400° C. to 750° C. at an average temperature rise rate of at least 10° C./sec, annealing for 50 seconds to 10 minutes within a temperature range of 780° to 820° C. in an oxidizing atmosphere having a ratio of the partial pressure of $H_2O$ to the partial pressure of $H_2$, $P_{H2O}/P_{H2}$, of from 0.4 to 0.7, then annealing for 10 seconds to 5 minutes within a temperature range of 830° to 870° C. in an oxidizing atmosphere for which the ratio in partial pressures $P_{H2O}/P_{H2}$ ranges from 0.08 to 0.4.

* * * * *